US005827167A

United States Patent [19]

Dougan et al.

[11] Patent Number: 5,827,167

[45] Date of Patent: Oct. 27, 1998

[54] THREE-PIECE WOUND GOLF BALL

[75] Inventors: Quintus E. Dougan, Fort Worth, Tex.; Daniel J. Cahill, Fairview Park, Ohio

[73] Assignee: Ben Hogan Company, Richmond, Va.

[21] Appl. No.: 837,234

[22] Filed: Apr. 10, 1997

[51] Int. Cl.[6] ..... A63B 37/06; A63B 37/12; A63B 37/14

[52] U.S. Cl. ..... 473/356; 473/357; 473/383; 473/378; 273/DIG. 20; 273/DIG. 10; 273/DIG. 22

[58] Field of Search ..... 473/357, 363, 473/364, 365, 383, 378; 273/DIG. 10, DIG. 20, DIG. 22

[56] References Cited

U.S. PATENT DOCUMENTS

| | | | |
|---|---|---|---|
| 4,076,255 | 2/1978 | Moore et al. | 473/359 |
| 4,625,964 | 12/1986 | Yamada | 473/373 |
| 4,696,475 | 9/1987 | Tomita | 473/365 |
| 4,714,253 | 12/1987 | Nakahara | 473/373 |
| 4,858,923 | 8/1989 | Gobush | 473/365 |
| 4,938,471 | 7/1990 | Nomura | 473/357 |
| 5,397,129 | 3/1995 | Kato | 473/365 |
| 5,409,233 | 4/1995 | Kennedy | 473/377 |
| 5,445,387 | 8/1995 | Maruko | 473/363 |
| 5,452,898 | 9/1995 | Yamagishi | 473/377 |
| 5,553,852 | 9/1996 | Higuchi | 473/373 |
| 5,704,853 | 1/1998 | Maruko et al. | 473/363 |

*Primary Examiner*—George J. Marlo
*Attorney, Agent, or Firm*—Martin Smolowitz

[57] ABSTRACT

A three-piece wound golf ball having improved characteristics of moment of inertia, initial spin and total flight distance with minimal dispersion, the ball comprising:

a solid center core portion which is substantially spherical, is composed mainly of polybutadiene having a core diameter of 1.35–1.50 inches (34.3–38.1 mm), a specific gravity of 1.23–1.24; and a Shore D durometer hardness of 55–75 and a compression of 59–75 on an Atti compression tester;

an intermediate thread-wound portion wound with an elastomeric thread material upon the core portion to a diameter of 1.540–1.600 inches (39.1–40.6 mm), the thread having an elongation of 800–1000%, a tensile strength of 4000–5000 psi, and a rectangular cross-section configuration of 0.0625 (+/−0.002) inch ×0.024 (+/−0.006) inch; and a cover portion form of a thermoplastic material having a flexural modulus of 5,000–10,000 psi, and a shore D durometer hardness of 55–65, the cover having multiple dimples provided therein occupying 70–80% of the surface area of the ball, the dimples having a total volume of 400–500 $mm^3$; the ball having an outside diameter of 1.680–1.688 inch (42.7–42.9 mm), a weight of 44.5 to 45.9 grams, a density of 1.090–1.118 $g/cm^3$, and an Atti compression reading of 85 +/−15 points.

9 Claims, 2 Drawing Sheets

THREE-PIECE WOUND GOLF BALL

BACKGROUND OF INVENTION

This invention pertains to an improved three-piece wound golf ball construction including a solid center core, an intermediate thread wound layer, and an outer cover piece. It pertains particularly to such a wound golf ball in which the core has larger diameter and decreased specific gravity so as to provide increased moment of inertia, spin rate and improved trajectory distance after being hit by any of various golf clubs.

Conventional known golf balls have either two-piece construction consisting of a center core and an outer cover with multiple dimples provided on its outer surface, or have three-piece construction consisting of a center core, an intermediate portion which may be solid or have elastomeric thread winding, and a solid dimpled cover. The cores are usually made of natural or synthetic rubber and may be either solid or have a liquid/paste form. The cover material is usually Balata or an ionomer in combination with a suitable filler material. Variations in the chemical or physical properties of the ball materials or their physical orientation can bring about changes in the golf ball characteristics, such as feel, flight distance, rebound coefficient, durability, moment of inertia, spin etc. as has been generally described in various prior art patents.

For example, U.S. Pat. No. 4,076,255 to Moore et al discloses a three-piece golf ball having a solid core formed from a cured composition comprising polybutadiene having a high cis-content, and a monomer capable of grafting, cross-linking or chain-extending the elastomer. The core having a Shore C hardness of 60–80 is wound with a conventional elastic thread and covered with a molded cover, but the core diameter is not disclosed.

U.S. Pat. No. 4,625,964 to Yamada discloses a three-piece solid golf ball having a core formed of polybutadiene with a specific gravity of at least 1.50 and a diameter not exceeding 32 mm (1.26 inch). The ball intermediate layer has a specific gravity lower than that of the core and thickness of 3.2–5.4 mm, and the cover has a thickness of 1–3 mm and a Shore D hardness not exceeding 64.

U.S. Pat. No. 4,696,475 to Tomita et al discloses a three-piece thread-wound golf ball having improved impact resiliency and increased flight distance. The core rubber and/or the winding thread contains more than 30% by weight of an isoprene-butadiene random copolymer and has core diameter of 28–30 mm (1.10–1.18 inch).

U.S. Pat. No. 4,714,253 to Nakahara et al, discloses a three-piece solid golf ball having controlled diameters, specific gravities, and hardnesses of the central core and intermediate solid layer. The central core has a diameter of 20 to 32 mm, (0.79–1.26 inch), specific gravity of 1.03 to 1.25, and a Shore C hardness of 57 to 80. The solid intermediate layer has 36–40 mm. diameter, specific gravity of 1.30–2.50 and Shore C hardness of 70–83, but it does not have a thread winding.

U.S. Pat. No. 5,397,129 to Kato et al discloses a three-piece thread-wound golf ball having a solid rubber core of 23 to 34 mm (0.91–1.34 inch) diameter. Various rubber types may be used for the core, the intermediate winding thread, and the molded cover, material including butadiene and natural rubbers.

U.S. Pat. No. 5,445,387 to Maruko et al discloses a three-piece thread-wound golf ball having a solid center of high cis-polybutadiene, a conventional thread-wound intermediate rubber layer, and a cover. The core hardness is continuously increased from its center to its outer surface. The solid core diameter is 26–31 mm (1.02–1.22 inch), the intermediate layer is 39–41 mm diameter, and ball diameter is 42.5–45 mm (1.67–1.77 inch).

Also, U.S. Pat. No. 5,553,852 to Higuchi et al discloses a three-piece solid golf ball having a center core of 29–37 mm (1.14–1.46 inch) diameter, hardness of 45–80 JIS C and a specific gravity of 1.05–1.4 but greater than that of the solid intermediate layer which has thickness of 1–3.5 mm (0.039–0.138 in.) and specific gravity of 0.9–1.2. The cover has 1–3 mm (0.039–0.118 in.) thickness and is softer than the intermediate layer.

Although golf balls having various constructions and characteristics are known, important deficiencies have been found by players to exist in these known golf ball constructions and flight characteristics. Specifically, the two-piece golf balls are far inferior in the controllability that is required when a shot is made with the middle iron or short iron clubs. In addition, a two-piece golf ball provides a poor shot feeling to the player. Known three-piece Balata golf balls exhibit spin rates that are, too great for good flight distance when hit with a Driver and long iron clubs. Thus, desirable improvements in golf ball construction and spin characteristics, all achieved at reduced ball manufacturing costs, have been sought.

SUMMARY OF INVENTION

This invention provides an improved solid three-piece golf ball construction having a desirable combination of characteristics, and which exhibits various desirable and advantageous flight characteristics depending upon the type of golf club with which it is struck. Specifically, when the present ball is hit with a driver, other woods or longer iron club, it desirably performs much like a distance two-piece golf ball; when hit with a mid-iron club, it performs much like a two-piece Hi-spin golf ball and soft covered multi-layered ball; and when hit with a short iron or putter the ball performs much like a three-piece liquid core Balata wound golf ball.

These desired flight characteristics for the spherical three-piece wound golf ball of this invention are achieved by providing a ball having a central solid homogeneous core which is substantially spherical and has a significantly increased diameter of 1.350–1.500 inch (34.3–38.1 mm), and preferably has 1.400–1.450 inch (35.6–36.8 mm) core diameter. The solid core is composed mainly of polybutadiene having some desirable additives, and has a specific gravity of 1.20–1.25 and a Shore D durometer hardness of 55–75, and a compression of 59–75 on a Atti compression tester. Suitable broad and preferred ranges for the chemical compositions for the golf ball core are provided in Table 1 below.

TABLE 1

Chemical Composition Ranges for Ball Solid Core, wt. %

| | Broad | Preferred |
|---|---|---|
| Polybutadiene | 58–61 | 59–60 |
| Zinc Diacrylate | 15–18 | 16–17 |
| Zinc Oxide | 20–24 | 21–23 |
| Dicumyl Peroxide | 0.7–0.9 | 0.75–0.85 |
| Peroxide Crosslinking | 0.6–0.8 | 0.65–0.75 |

TABLE 1-continued

| Chemical Composition Ranges for Ball Solid Core, wt. % | | |
|---|---|---|
| | Broad | Preferred |
| Antioxidant | 0.2–0.4 | 0.25–0.35 |
| Magnesium Stearate | 0–0.4 | 0.2–0.35 |
| Totals | 100 | 100 |

The ball core diameter is significantly larger and the core specific gravity is significantly lower than that for three-piece solid core wound golf balls which are normally available on the market at the present time. Accordingly, the ratio of the ball solid core diameter or volume to its specific gravity is significantly greater than for other known golf balls. Specifically, for the ball diameter expressed in inches, this ratio should be in a broad range of 0.9/1–1.30/1, and preferably should be 1.0/1–1.25/1. The larger solid core diameter and its lower specific gravity, in combination with the thread type for the thread-wound intermediate layer and the outer solid cover material and thickness, results in a significant desirable transfer of the ball weight and moment of inertia towards its peripheral portion. Consequently, there is a desirable increase in the total moment of inertia for the ball, which results in a corresponding increase in the initial relative spin rate of the ball after being hit with various golf clubs, as compared to other known golf balls.

According to the present invention, the ball solid central core portion having 1.35–1.50 inch (34.3–38.1 mm) diameter is thread wound to a diameter of 1.540–1.600 inch (39.1–40.6 mm) and preferably to 1.560–1.580 inch (39.6–40.1 mm) diameter. The winding thread is a high velocity elastomeric thread material used to provide a wound intermediate portion. The thread winding material consists of blended natural and synthetic rubber having an elongation of about 800–1000%, tensile strength of about 4000–5000 psi, and a rectangular cross-section dimension of 0.0625(+/−0.002) inches×0.024 (+/−0.006) inches. The ball cover layer or portion consists of a solid thermoplastic material having a density of 1.00–1.04 g/cm$^3$, a flexural modulus of 5,000–10,000 psi, and a Shore D durometer hardness of 55–65. The surface of the cover portion has many small shallow dimples occupying 70–80% of the ball surface area, the dimples having a total volume of 400–500 mm$^3$. The finished golf ball has an outer diameter of 1.680–1.688 inches (42.7–42.9 mm), a weight of 44.5–45.9 gr, a density of 1.090–1.113 g/cm$^3$, and an Atti compression reading of 85+/−15 points.

One useful material blend for the golf ball cover portion contains by weight 25%+/−5% by weight of a sodium ionomer (Dupont Surlyn 8140), 69%+/−5% of a zinc ionomer (Dupont Surlyn 9320) and 6% of a sodium ionomer (Dupont Surlyn 8660) in combination with 58% titanium dioxide. Another useful blend for the ball cover contains by weight 50%+/−5% of a sodium ionomer (Dupont Surlyn 8140), 44%+/−5% of a zinc ionomer (Dupont Surlyn 9320) and 6% of a sodium ionomer (Dupont Surlyn 8660) in combination with 58% titanium dioxide.

This invention advantageously provides a three-piece wound golf ball having a solid center core of increased core diameter and reduced specific gravity and an elastomeric thread wound intermediate portion, which results in a desirable increased moment of inertia and spin characteristic for the ball during flight after being struck by a selected golf club. The ball thereby provides an overall desirable combination of characteristics for use under a wide range of playing conditions.

Another advantage of this invention is that three-piece golf balls are usually made with a small diameter center of only about 1.0–1.06 inch diameter, which is typically either a lively rubber ball or a liquid-filled hollow sphere. During ball manufacture, these centers must be frozen and a considerable amount of thread must be wound onto the center to bring it up to an established diameter. But for the present invention, the ball manufacturing costs are reduced by cost of the medium used to freeze the centers. Furthermore, because the center is larger in diameter, the amount and cost of the winding thread being applied to the center core and the time needed to wind it to the established size are both desirably reduced.

BRIEF DESCRIPTION OF DRAWINGS

This invention will now be described further with reference to the following drawings, in which.

DESCRIPTION OF INVENTION

Figure 1:
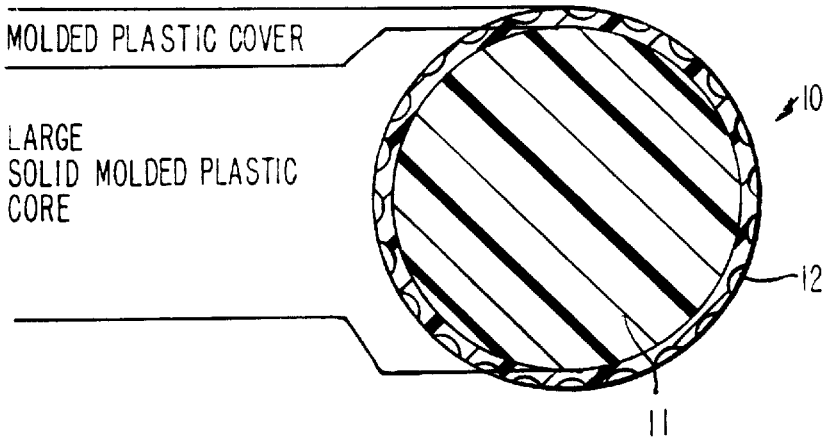
FIG. 1 PRIOR ART
FIGS. 1 and 2 each show a cross-sectional view of a conventional two-piece high spin golf ball and a conventional three-piece golf ball having a liquid center, respectively.
Figure 2:
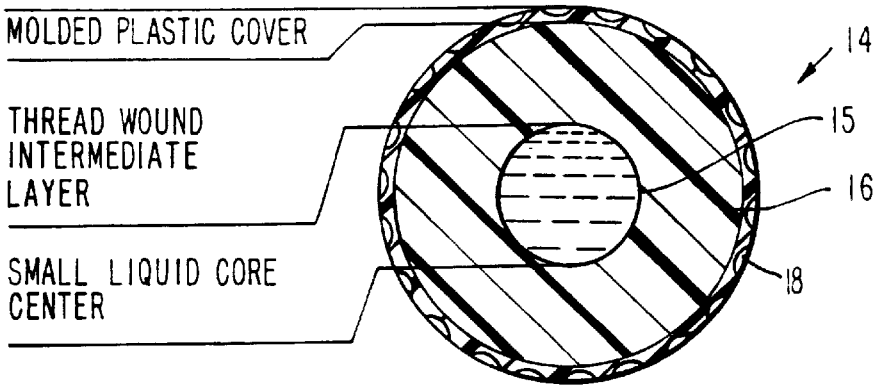
FIG. 2 PRIOR ART

As shown by FIG. 1, a conventional two-piece golf ball 10 includes a solid core 11 and an outer molded cover 12, but without an intermediate layer or portion. The conventional three-piece golf ball 14, as shown by FIG. 2, includes a liquid core center 15, a thread wound intermediate layer 16, and a outer molded cover 18.

Figure 3:
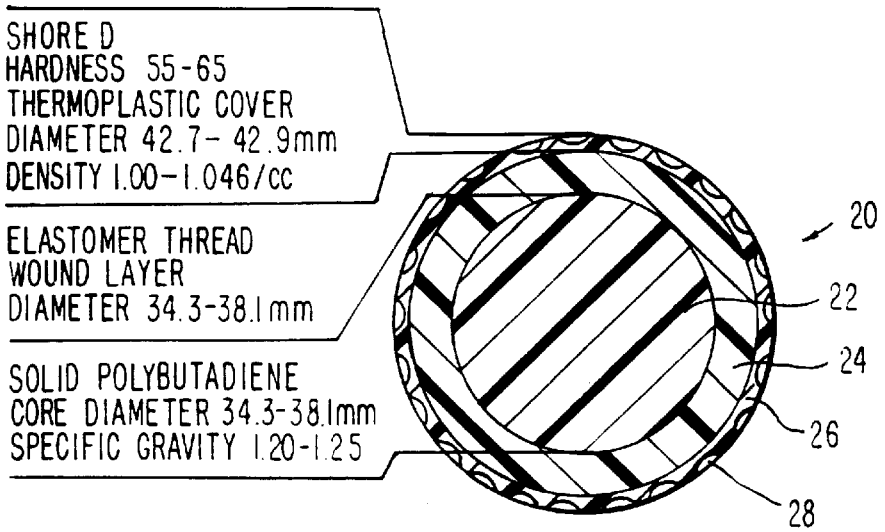
FIG. 3 shows a cross-sectional view of an improved three-piece golf ball having larger solid center core and a thread wound intermediate layer all constructed according to the present invention.

The present invention is directed to an improved three-piece thread wound golf ball 20, as shown in cross-section by FIG. 3. The ball comprises a solid center core 22 formed substantially of polybutadiene material and having an increased diameter of between 1.35–1.50 inches (34.3–38.1 mm), with the preferred core diameter being 1.400–1.450 inches (35.6–36.8 mm). The core portion 22 is surrounded by an intermediate thread-wound portion 24, which is surrounded by an outer solid cover 26 on which is provided multiple shallow dimples 28 covering the outer surface of the ball.

An important characteristic of the inner core portion 22 is that it has significantly larger diameter and lower specific gravity than cores which are provided for known three-piece wound golf balls at the present time. The core 22 larger diameter and lower specific gravity in combination with the diameter and type of winding thread used in the intermediate portion 24 and the material for outer cover 26, results in a significant proportional transfer of weight of the golf ball outwardly towards its perimeter. As a result, there is an increase in the moment of inertia for the ball, and consequently there is an increase in the initial spin rate of the ball 20 after being hit with a particular golf club. This golf ball construction provides a greater degree of control of the ball spin and trajectory flight distance than is provided by other known golf balls. The ball increased core diameter and reduced specific gravity has a significant importance when used in combination with the intermediate thread winding and cover dimensions and materials.

The outer portions of the three-piece wound golf ball as shown in FIG. 3 includes the intermediate portion 24 which is wound tightly with a high velocity type elastomer thread material compared of blended natural and synthetic rubbers, and the outside cover 26 which exhibits the characteristics of a Balata cover material. The thread winding material employed provides an increase in initial ball velocity after being hit by a club. The ball cover is formed of a thermoplastic material having a density of 1.00–1.04 gm/cm$^3$ and many shallow dimples; and is able to impart flight control over a trajectory distance similar to that for conventional two-piece, multi-layer, and Balata three-piece wound balls.

Because of the increased diameter and lower specific gravity of the ball center core portion, it has been found that the golf ball according to this invention provides improved spin characteristics when struck by various golf clubs, including a No. 1 wood driver, and No. 3, 6 and 9 iron clubs. Specifically, the initial ball spin rate expressed in revolutions per minute after being struck by the higher numbered clubs, i.e. by the 3-iron, 6-iron and 9-iron clubs, exceeds the ball initial spin rate after being struck with a No. 1 Driver club by minimum initial spin ratios as listed in Table 2 below.

TABLE 2

Golf Ball Initial Spin Ratio Characteristics

| Golf Clubs Used | Ball Initial Minimum Spin Ratio |
|---|---|
| 3-iron vs. Driver | 1.8 |
| 6-iron vs. Driver | 2.3 |
| 9-iron vs. Driver | 3.0 |

As a result of the improved ball spin characteristics, the solid three-piece solid core golf ball of this invention also provides flight trajectory distances at least equal to or exceeding that of other known competitive golf balls.

This invention will be described further by the following Example, which should not be regarded as limiting in its scope.

EXAMPLE 1

The three-piece solid core thread wound golf balls were constructed having materials, dimensions and characteristics as follows:

| | |
|---|---|
| Core material | polybutadiene |
| Core diameter, in. | 1.400 (3.56 mm) |
| Core specific gravity | 1.236 |
| Ratio core diameter/specific gravity | 1.13/1 |
| Intermediate thread winding material | Natural and synthetic rubber |
| Thread cross-sectional dimensions, in. | 0.062 × 0.024 |
| Intermediate layer diameter, in. | 1.550 (39.4 mm) |
| Intermediate layer thickness, in. | 0.075 (1.90 mm) |
| Cover material | ionomer |
| Cover thickness, in. | 0.65 (1.65 mm) |
| Ball diameter, in. | 1.680 |

Comparative ball spin test results for the golf ball of the present invention as compared to known golf balls obtained using a True Temper made robot and are listed in Table 3 below, and are also shown graphically by FIG. 4.

TABLE 3

Golf Ball Initial Spin Rate Comparison Using Various Clubs

| | Golf Clubs Used | | | | Ball Spin Ratios | | |
|---|---|---|---|---|---|---|---|
| Ball Type | Driver | 3 Iron | 6 Iron | 9 Iron | 3I/D | 6I/D | 9I/D |
| 2 PC Distance | 2729 | 4500 | 6286 | 7500 | 1.65 | 2.30 | 2.75 |
| 2 PC Hi-Spin | 2675 | 4912 | 6673 | 7857 | 1.84 | 2.49 | 2.94 |
| 3 PC Balata* | 3419 | 6212 | 7308 | 9700 | 1.82 | 2.14 | 2.84 |
| 3 PC Tour** | 2734 | 4912 | 6429 | 9371 | 1.80 | 2.35 | 3.43 |
| 3PC TourSpin** | 2847 | 5306 | 6595 | 9471 | 1.86 | 2.31 | 3.33 |

*Balata ball has liquid center
**Golf ball construction of present invention.

Figure 4:
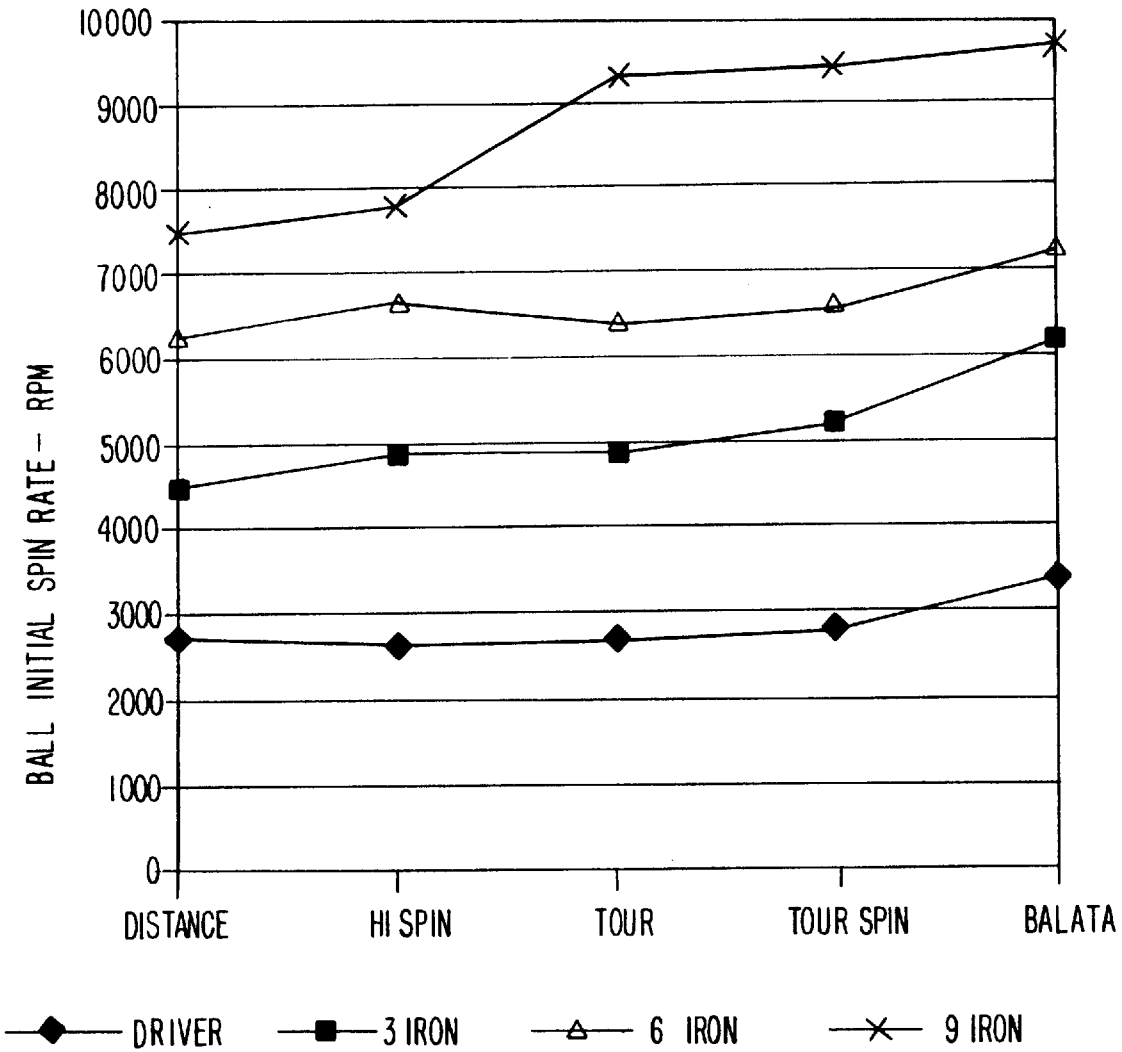
FIG. 4 shows golf ball comparative initial spin rates after being struck by the various numbered standard golf clubs.

Based upon this golf ball comparative spin rate data in Table 3 and FIG. 4, it is seen that the two golf balls constructed according to the present invention provide spin results substantially equal to or better than that for known 3-piece Balata golf balls. More specifically, as generally shown in Table 3 and FIG. 4, the ball initial spin rate expressed in revolutions per minute show that the ball construction of the improved three-piece wound golf ball spins much like a two piece distance golf ball when hit with a Driver, and long irons, like a two-piece Hi Spin golf ball when hit with mid iron-clubs, and when hit with a short iron club, the ball performs much like a Balata wound golf ball.

Comparative test results for total flight distance for the golf ball of the present invention as compared to other known balls after being struck by a Driver, 5 iron club and 9 iron club is provided in Table 4 below.

TABLE 4

Struck Ball Total Flight Distance (Yards)

| Ball Type | Driver | 5 Iron | 9 Iron |
|---|---|---|---|
| Top Wind J Blend 1.400" Tour Spin | 267 | 189 | 132 |
| Top Wind D Blend 1.400" Tour | 269 | 187 | 132 |
| Hogan Balata | 260 | 184 | 132 |
| Titleist Professional | 266 | 188 | 131 |
| Titleist tour Balata | 260 | 188 | 130 |
| Slazenger 420 Balata | 265 | 189 | 131 |
| Maxfli Ht Balata | 264 | 189 | 132 |
| Top Flite Strata | 266 | 189 | 134 |
| Precept Tour | 267 | 186 | 132 |

From the above comparative ball flight distance results per Table 4, it is seen that the golf ball of the present invention has the favorable flight characteristic of the Balata covered ball and also the flight distance of a two-piece and multi-layer golf ball. The combinations of elements as described provide a golf ball that at least substantially duplicates and even improves upon the desirable properties of the Balata-covered ball while overcoming the expense and lack of durability associated with the Balata covered ball.

Although this three-piece wound golf ball invention has been described broadly and also in terms of preferred embodiments, it will be understood that minor modifications and variations can be made to portions of the ball which is defined by the following claims.

We claim:

1. A three-piece wound golf ball having improved characteristics of moment of inertia, initial spin and total flight distance with minimal dispersion, the ball comprising:

a solid center core portion which is substantially spherical, is composed mainly of polybutadiene having a core diameter of 1.35–1.50 inches (34.3–38.1 mm),a specific gravity of 1.23–1.24; and a Shore D durometer hardness of 55–75 and a compression of 59–75 on an Atti compression tester;

an intermediate thread-wound portion wound with an elastomeric thread material upon said core portion to a diameter of 1.540–1.600 inches (39.1–40.6 mm), said thread having an elongation of 800–1000%, a tensile strength of 4000–5000 psi, and a rectangular cross-section configuration of 0.0625(+/−0.002) inch×0.024 (+/−0.006) inch; and a cover portion formed of a thermoplastic material having a flexural modulus of 5,000–10,000 psi, and a Shore D durometer hardness of 55–65, said cover having multiple dimples provided therein occupying 70–80% of the surface area of the ball, the dimples having a total volume of 400–500 $mm^3$; the ball having an outside diameter of 1.680–1.688 inch (42.7–42.9 mm), a weight of 44.5 to 45.9 grams, a density of 1.090–1.118 $g/cm^3$, and an Atti compression reading of 85+/−15 points.

2. The golf ball according to claim 1, wherein the core material is homogeneous and contains by weight 58–61% polybutadiene mixed with 15–18% zinc diacrylate and 20–24% zinc oxide.

3. The golf ball according to claim 1, wherein the core diameter is 1.400–1.450 inch (35.6–36.8 mm).

4. The golf ball according to claim 1, wherein the ratio of core diameter expressed in inches to the core specific gravity is in a range of 0.9/1–1.3/1.

5. The golf ball according to claim 1, wherein the intermediate thread-wound portion has an outer diameter of 1.56–1.58 inch (39.6–40.1 mm).

6. The golf ball according to claim 1, wherein the cover formulation contains by weight 25%+/−5% of a sodium ionomer, 69%+/−5% of a zinc ionomer, and 6% of a sodium ionomer in combination with 58% titanium dioxide.

7. The golf ball according to claim 1, wherein the cover formulation contains by weight 50%+/−5% of a sodium ionomer, 44%+/−5% of a zinc ionomer and 6% of a sodium ionomer in combination with 58% titanium dioxide.

8. The golf ball according to claim 1, wherein the ball initial spin rate after being struck by a No. 3 iron club, a No. 6 iron club, and a No. 9 iron club exceeds the initial spin rate after being struck by a No. 1 Driver club by a spin ratio of at least about 1.80/1 for the No. 3 club, at least about 2.30/1 for the No. 6 club, and at least about 3.0/1 for the No. 9 club.

9. A three-piece wound golf ball having improved characteristics of moment of inertia, initial spin and total flight distance with minimal dispersion, the ball comprising:

a solid center core portion which is substantially spherical, is composed mainly of polybutadiene having a core diameter of 1.40–1.45 inches, (35.6–36.8 mm), a specific gravity of 1.23–1.24, and a Share D durometer hardness of 55–75; the ratio of core diameter expressed in inches to the core specific gravity being in a range of 0.9/1–1.3/1; and a compression of 59–75 on a Atti compression tester;

an intermediate thread-wound portion wound with an elastomeric thread upon said core portion to a diameter of 1.560–1.580 inches (39.6–40.1 mm), said thread having an elongation of 800–1000%, a tensile strength of 4000–5000 psi and a rectangular cross-section configuration of 0.0625(+/−0.002) inch×0.024 (+/−0.006) inch; and a cover portion formed of a thermoplastic material having a density of 1.00–1.04 $g/cm^3$, a flexural modulus of 5,000–10,000 psi, and a Shore D. durometer hardness of 55–65, said cover having multiple dimples provided therein occupying 70–80% of the surface area of the ball, the dimples having a total volume of 400–500 $mm^3$; the ball having an outside diameter of 1.680–1.688 inch (42.7–42.9 mm), a weight of 44.5 to 45.9 grams, a density of 1.090–1.118 $g/cm^3$, an Atti compression reading of 85+/−15 points.

* * * * *